United States Patent [19]

Schuldt

[11] 4,436,989

[45] Mar. 13, 1984

[54] CASH DRAWER FOR CASH REGISTERS IN TELLERS' STATIONS, SALES COUNTERS OR THE LIKE

[75] Inventor: Gerhardt Schuldt, Oerlinghausen, Fed. Rep. of Germany

[73] Assignee: ADS - Anker GmbH, Bielefeld, Fed. Rep. of Germany

[21] Appl. No.: 324,431

[22] Filed: Nov. 24, 1981

[30] Foreign Application Priority Data

Aug. 14, 1981 [EP] European Pat. Off. ..... 81-106327

[51] Int. Cl.[3] ..... G07G 1/00

[52] U.S. Cl. ..... 235/22; 235/1 R; 235/10

[58] Field of Search ..... 235/10, 22, 1 R, 1 E; 312/291, 333, 334, 335, 338, 345, 330 R

[56] References Cited

U.S. PATENT DOCUMENTS 2,070,064 2/1937 Pasinski ..... 235/22 X 3,744,869 7/1973 Anderson et al. ..... 312/330 R

*Primary Examiner*—Benjamin R. Fuller

*Attorney, Agent, or Firm*—Herbert L. Lerner; Laurence A. Greenberg

[57] ABSTRACT

Cash drawer for cash registers in tellers' stations, sales counters or the like, including a slide-in unit and a drawer tray being movable into and out of the slide-in unit in given directions; the slide-in unit having vertical side plates at opposite sides thereof, a rib being integral with each of the side plates extended along the given directions and projecting toward each other, a rack integral with the top of each of the ribs, and a roller disposed in vicinity of the front of each of the side plates; a guide shaft being rotatably supported at the back of the drawer tray, a pinion being fastened to each end of the guide shaft and being in engagement with one of the racks of the side plates; and the drawer tray having sides and a longitudinal flange integral with each of the sides of the drawer tray being extended along the given directions and supported on the rollers when the drawer is opened and closed.

11 Claims, 7 Drawing Figures

CASH DRAWER FOR CASH REGISTERS IN TELLERS' STATIONS, SALES COUNTERS OR THE LIKE

The invention relates to a cash drawer for cash registers in tellers' stations, sales counters or the like with a slide-in unit for receiving a drawer tray. A drawer for cash registers with a slide-in unit for receiving a drawer tray is known from German Published, Non-Prosecuted Application DE-OS No. 27 25 371. Since it is desirable, in order to improve the working conditions for the operators of cash registers, for the cash drawer in the opened condition not to extend out so far that the operation of the cash register is impeded, it is endeavored to make the cash drawer wider and shallower. In view of the lower overall depth it is difficult to support wide slide-in units with the drawer tray in such a manner that canting is avoided when opening and closing.

It is accordingly an object of the invention to provide a cash drawer for cash registers in tellers' stations, sales counters or the like, which overcomes the hereinaforementioned disadvantages of the heretofore-known devices of this general type, and to construct the drawer guiding mechanism in such a manner that even with an extreme width and small depth, canting is avoided when the drawer is moved in and out.

With the foregoing and other objects in view there is provided, in accordance with the invention, a cash drawer for cash registers in tellers' stations, sales counters or the like, comprising a slide-in unit and a drawer tray being movable into and out of the slide-in unit in given directions; the slide-in unit having vertical side plates at opposite sides thereof, a rib being integral with each of the side plates extended along the given directions and projecting toward each other and toward the inside of the unit, a rack integral with the top of each of the ribs, and a roller disposed in vicinity of the front end of each of the side plates; a guide shaft being rotatably supported at the back of the drawer tray, a pinion being fastened to each end of the guide shaft and being in engagement with one of the racks of the side plates; and the drawer tray having sides and a longitudinal flange integral with each of the sides of the drawer tray being extended along the given directions at the long sides of the drawer and rollably supported on the rollers when the drawer is opened and closed.

In accordance with another feature of the invention, there is provided a fixed running flange with a running surface being integral with the inner surface of each of the side plates and extended along the given directions, and a guide roller being rotatably supported at each end of the guide shaft for rolling on the fixed flange.

In accordance with a further feature of the invention, there is provided a guide flange being integral with the upper edge of each of the side plates and angled-off horizontally toward the inside, the guide flange being spaced at an inside distance from the running surface by a distance which is greater by a small amount than the diameter of the guide rollers.

In accordance with an added feature of the invention, there is provided a carriage supporting the guide shaft at the back of the drawer tray, the carriage including two vertical side struts, a cross strut connecting the backs of the side struts to each other, bearing pins disposed on the side struts, and support rollers disposed on the bearing pins at the inner surface of the side struts for supporting the drawer tray in the carriage along the given directions.

In accordance with an additional feature of the invention, there is provided a cover, a lock disposed on the drawer tray, and a stop being disposed on the cover and being engageable by the lock for limiting the travel direction of the drawer tray in the carriage.

In accordance with again another feature of the invention, there is provided a spring connected to the guide shaft being biased when the drawer is closed and the pinions roll off on the racks of the ribs of the side plates.

In accordance with again a further feature of the invention, there are provided means for locking the drawer tray when the drawer is closed by locking the guide shaft.

In accordance with again an added feature of the invention, there is provided a cover and gear means coupled to the drawer tray guide for opening the cover when the drawer tray is run out and for closing the cover when the drawer tray is returned to a closed position.

In accordance with again an additional feature of the invention, the cover is a slide being guideable on both sides of the slide-in unit above the drawer tray and having a lower surface, and the gear means conprise racks integral with the lower surface, racks being integral with both of the sides of the drawer tray extended in the longitudinal direction parallel to the upper edges of the sides, bearing pins disposed on the side plates of the slide-in unit, and pinions being supported on the bearing pins and being in engagement with the racks integral with the lower surface of the cover slide and with the racks integral with the sides of the drawer tray.

In accordance with yet another feature of the invention, the cover includes a flap disposed in the forward region thereof for uncovering the drawer tray, and the gear means comprise sensing fingers connected to the cover flap and guide strips having curved tracks formed thereon and being disposed on each of the sides of the drawer tray, the sensing fingers cooperating with the curved tracks for flipping up the cover flap when the drawer tray is run out.

In accordance with a concomitant feature of the invention, the guide strips have undercuts of the curved tracks formed therein, and the sensing fingers have rollers disposed thereon being slideable on the curved tracks and receivable in the undercuts for locking the cover flap in the closed position of the drawer.

The invention prevents any canting of the drawer tray in the slide-in unit even with extremely wide cash drawers of small depth. The wider drawer tray also permits the use of a smaller working opening which benefits the operation of the cash register as an operating improvement.

Other features which are considered as characteristic for the invention are set forth in the appended claims.

Although the invention is illustrated and described herein as embodied in a cash drawer for cash registers in tellers' stations, sales counters or the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figures 1, 2:
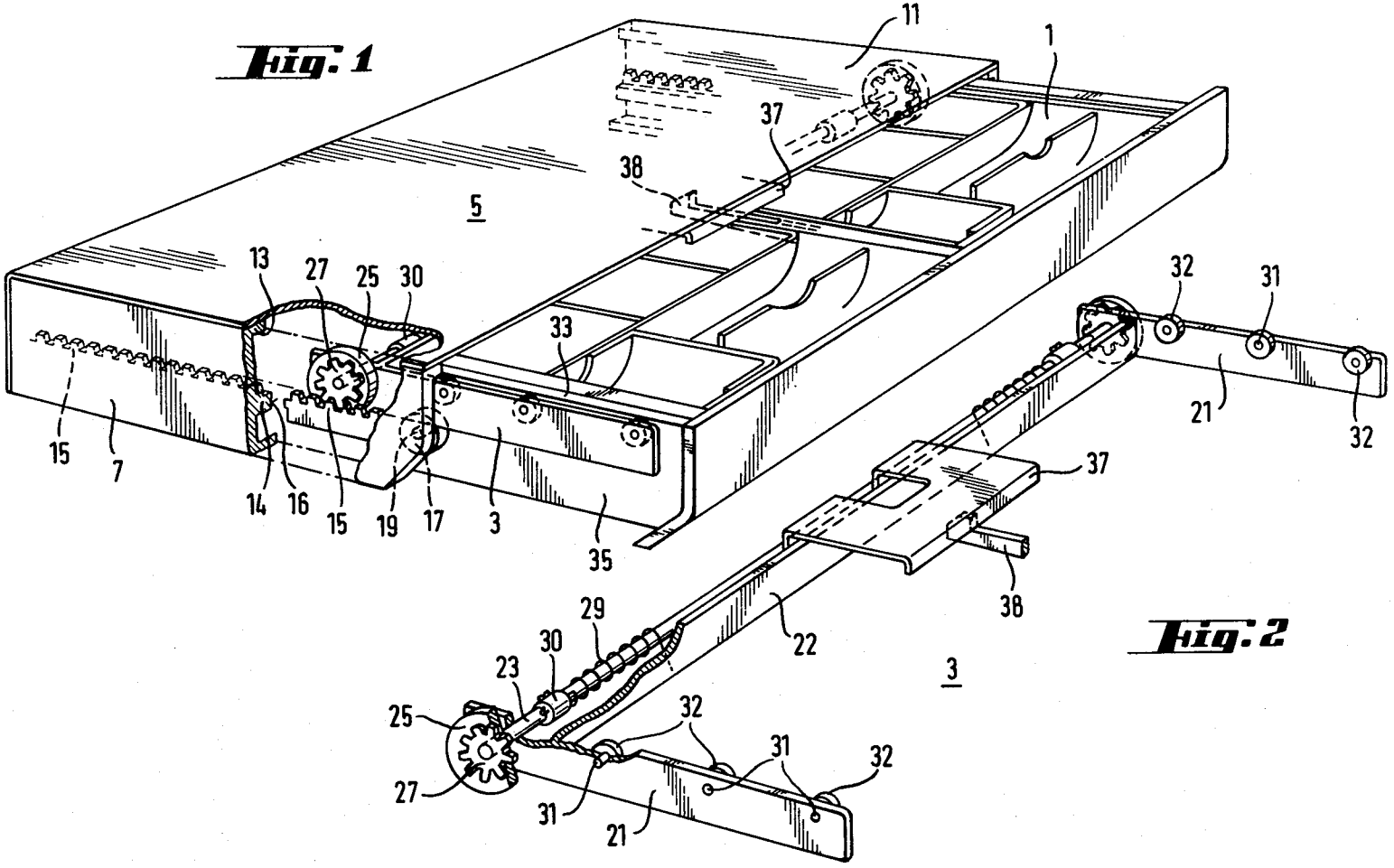
FIG. 1 is a diagrammatic perspective view, partly broken away, of the drawer of the invention in the opened condition.
FIG. 2 is a perspective view, partly broken away, of the carriage.
Figure 3:
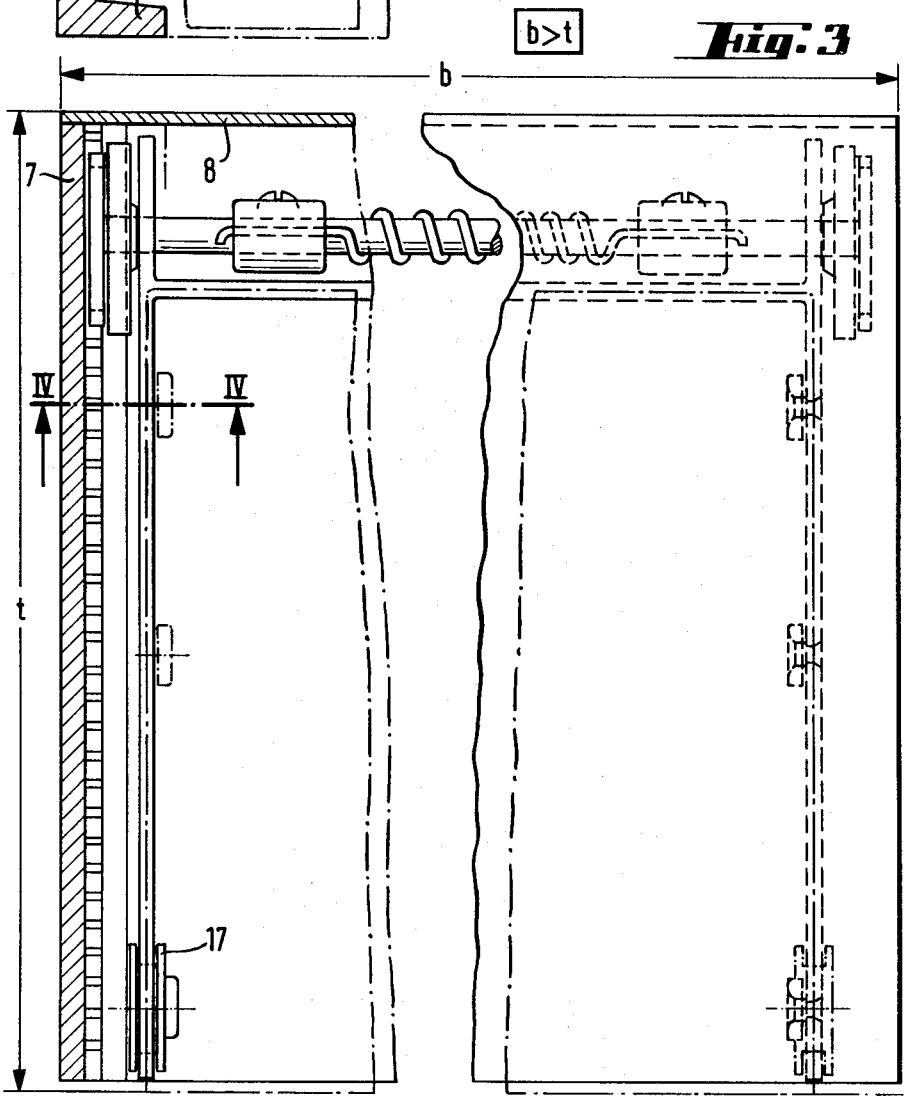
FIG. 3 is a partly cross-sectional fragmentary top plan view onto the drawer without a cover.

Referring now to the figures of the drawing and first particularly to FIG. 1 thereof, it is seen that the drawer includes a drawer tray 1, a carriage 3 and a slide-in unit 5. The drawer tray 1 is equipped in the known manner with different size compartments for coins and bills. It is important that the width b of this drawer tray is larger than its depth t, as shown in FIG. 3. The slide-in unit includes two side plates 7 which are connected to each other at their rear edges by a back wall 8 also shown in FIG. 3, other supporting structural elements or housing parts, a bottom plate 9 shown in FIG. 4 and a cover 11 of the top surface. The bottom plate 9 may have a rectangular cutout formed therein in the region under the drawer tray 1.

Figure 4:
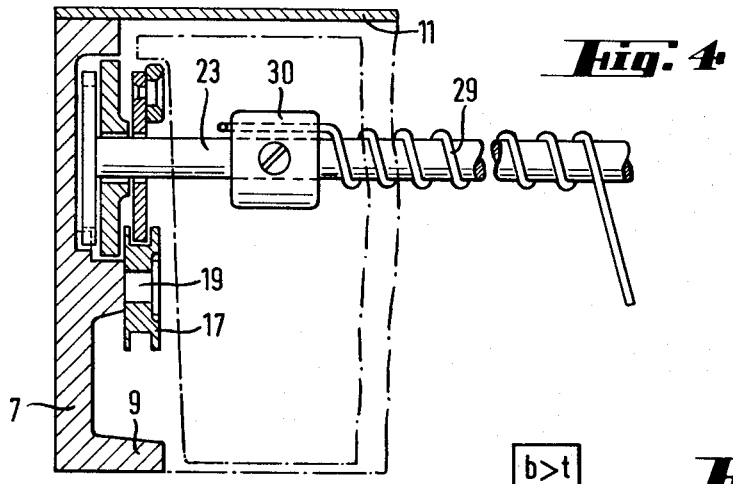
FIG. 4 is a fragmentary cross-sectional view taken along the line IV—IV in FIG. 3, in the direction of the arrows.

The vertical side plates 7 shown in FIGS. 1 and 4 have a horizontal guide rib 13 at their upper edges which extends over the length of the side plates 7 and points toward the interior of the drawer, as well as a rib 14 which extends approximately along the middle of the inside of the plates 7 and likewise over the entire length. The rib 14 has at its upper edge a rack 15 and a running strip 16 formed thereon which is somewhat shifted downwardly.

The running strip 16 and the guide rib 13 are mutually parallel and have approximately the same overhang from the vertical wall of the side plate 7. At the forward ends of each side plate 7, a roller 17 is disposed and rotatably supported on a bearing pin 19 near the lower edge.

The carriage 3 shown in FIG. 2 includes two lateral strurs 21 which are connected to each other near their rear edges by a cross strut 22 in such a manner that a guide shaft 23 can be supported at their rearwardly projecting ends. At each side of the ends of the guide shaft 23, a roller 25 is freely rotatably supported, and a pinion 27 is fastened. When the carriage 3 is inserted into the slide-in unit 5, the pinions 27 are in engagement with the racks 15 and the ribs 14 while the guide rollers 25 are simultaneously guided between the guide ribs 13 and the running strips 16, since the inner distance between the guide strips 13 and the running strips 16 is chosen to be larger than the diameter of the guide rollers 25 by a small amount. At the same time, the lateral struts 21 are supported at their lower edges by the rollers 17. Depending on the load in the drawer tray 1 due to its contents, the guide roller 25 will roll either on the running strips 16 or under the guide ribs 13 when the drawer is pulled out or pushed in. To improve the guidance of the carriage 3, it is advantageous to provide the running surfaces of the roller 17 with a chamfer which is adapted to the width of the lateral struts 21.

The guide shaft 23 carries a coil spring 29, one end of which is connected to the guide shaft 23 by means of a setting ring 30, while the other end thereof is braced in the cocked or locked condition against the cross strut 22. It will be seen that the coil spring is cocked or biased when the drawer is closed so that the drawer tray runs out automatically when the drawer is opened. The setting ring 30 allows individual adaptation to the thrust of the spring required in each case.

The side struts 21 of the carriage 3 carry several support rollers 32 on the inside thereof which run on bearing pins 31. The drawer tray 1 rests on the rollers 32 with a narrow outwardly projecting strip 33 of the upper edge of the lateral surfaces 35. This manner of support permits pulling out the drawer tray 1 on the extended carriage over an additional travel distance if this is desired. This additional pulling out of the drawer tray 1 is limited by a stop 37 of the upper cover 11. A detent hook 38 at the rear wall of the drawer tray 1 strikes against the stop 37. By withdrawing or swinging out the detent hook 38, the drawer tray 1 is released for removal from the carriage 3.

It will be immediately understood that through the construction of the guide shaft 23 with the pinions 27 disposed on both sides being in engagement with the racks 15 of the side plates 7, canting of the drawer tray 1 in the slide-in unit 5 is completely prevented, even in the case of an extremely wide drawer of small depth. It is particularly advantageous if the drawer is normally opened by spring force only as far as is required by the normal money traffic at the cash register. If a major change of money is required and access to further deposit compartments in the rear part of the drawer tray becomes necessary, the drawer can be opened further by hand. As a further advantage, the guidance of the drawer according to the inention allows a simple construction of the drawer locking mechanism, since the manufacturer can place the locking mechanism at any point of the drawer because of the stabilization of the carriage guidance. In addition, the locking of the guide shaft 23, such as by locking the pinion 27 with respect to the carriage 3 or the slide-in unit 5, permits a secure closing of the cash drawer.

The pinion 27 can be locked in a simple manner by a latch which engages the teeth of the pinion and is controlled mechanically by the lock of the cash drawer or electromagnetically by the cash register.

Figure 5:
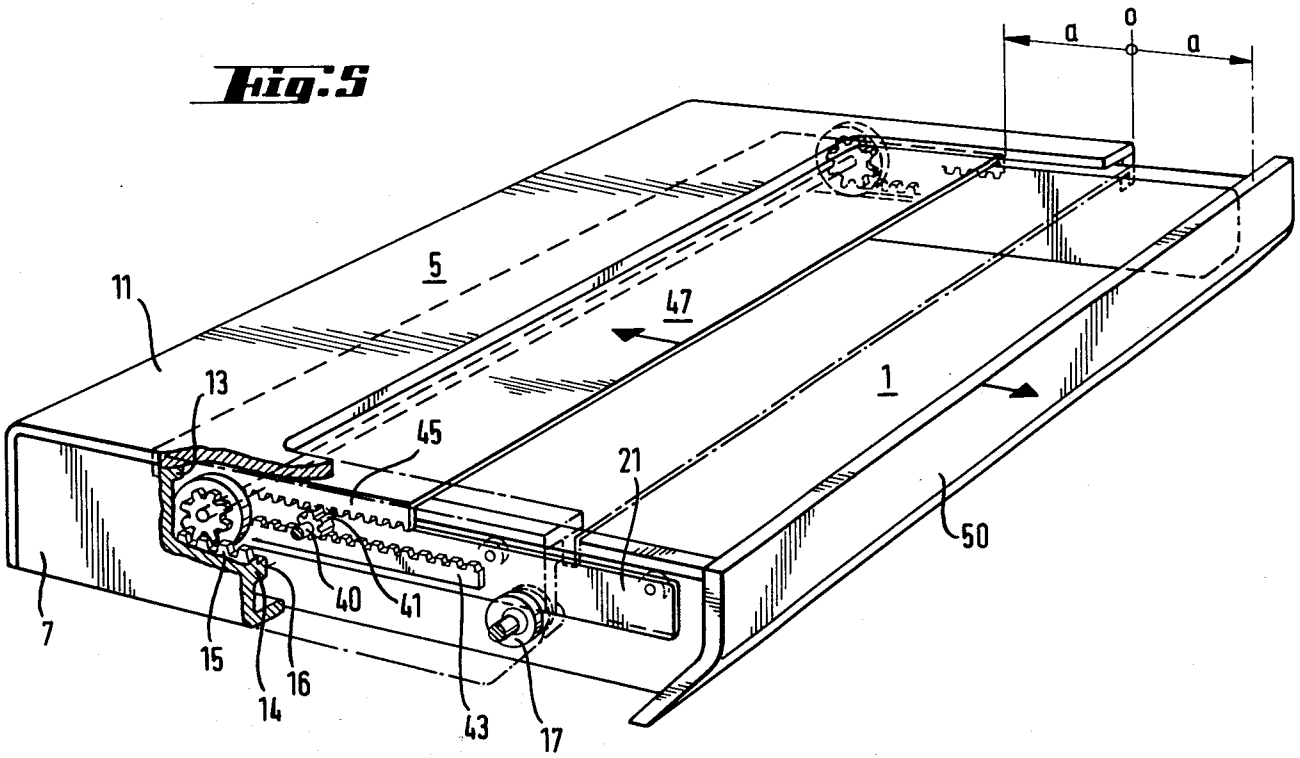
FIG. 5 is a perspective view, partly broken away, of a drawer with a cover slider.
Figure 6:
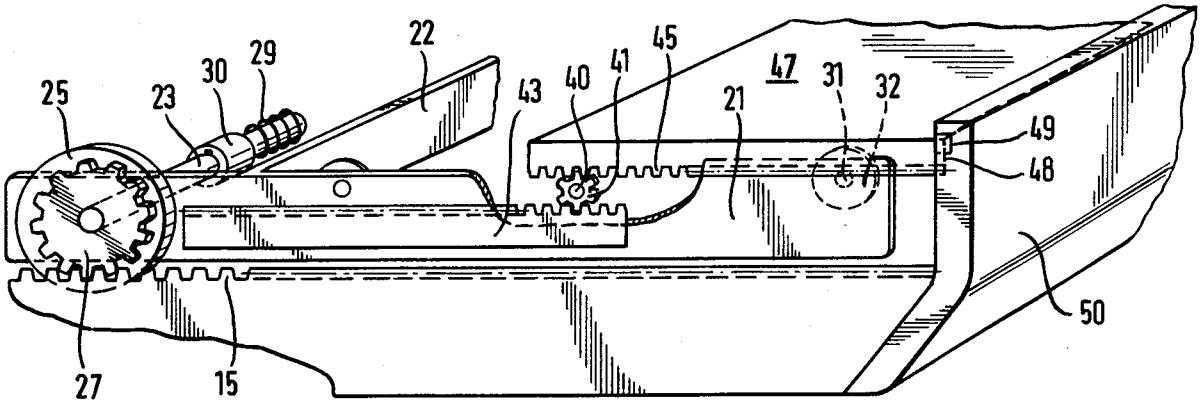
FIG. 6 is a fragmentary perspective view showing details of the gears for shifting the cover slider.

A second embodiment of the invention shown in FIGS. 5 and 6 is characterized by providing a reduction of the opening stroke of the drawer tray by one-half yet providing availability of the full area of the drawer tray, by pushing back part of the cover when the drawer is pulled out. As in the first embodiment, the drawer shown in FIG. 5 includes a drawer tray 1, a carriage 3 and a slide-in unit 5 which includes two side plates 7, a rear wall, a non-illustrated bottom plate and a cover 11 on the upper surface. The vertical side plates 7 likewise have a horizontal guide rib 13 at their upper edge and, approximately in the middle of the inside thereof, they have a rib 14 which has at its upper edge a rack 15 and a running strip 16 that is somewhat shifted downwardly. The guidance of the carriage 3 in the slide-in unit 5 is constructed in the same manner as in the first embodiment. On the inside of each of the two side plates 7, there is provided a freely rotatable pinion 41 disposed on a bearing pin 40; the pinion meshes on one hand with the teeth of a rack 43 fastened along the side strut 21, and on the other hand with a rack 45 disposed on the underside of a covering slide 47. FIG. 6 shows the position of the gear arrangement with the cash drawer closed. The cover slider 47 extends with its forward edge 48 into a longitudinal slot 49 formed in the inside of the front wall 50 of the drawer tray 1. If the non-illustrated lock of the closed drawer is released, the coil spring 29 drives the guide shaft 23 clockwise. As the pinion 27 runs off on the rack 15, the carriage 3 and the lateral struts 21, respectively, are pushed to the right in FIG. 6 together with the drawer tray 1.

The movement to the right of the lateral struts 21 and the racks 43 connected thereto causes a shift to the left of the cover slider 47 by way of the stationery pinion 41 and the rack 45. This means, that a shift to the right of the drawer tray 1 corresponds to a corresponding shift to the left of the cover slide 47. Upon motion of the drawer tray through the distance "a" in FIG. 5, the drawer tray is opened by the distance 2a. For closing the drawer, the drawer tray 1 is pushed back into the slide-in unit 5 by hand, whereby a shift of the cover slider 47 in the opposite direction is achieved until the drawer is completely closed, by the action of the lateral struts 21, the racks 43 and the pinions 41.

Figure 7:
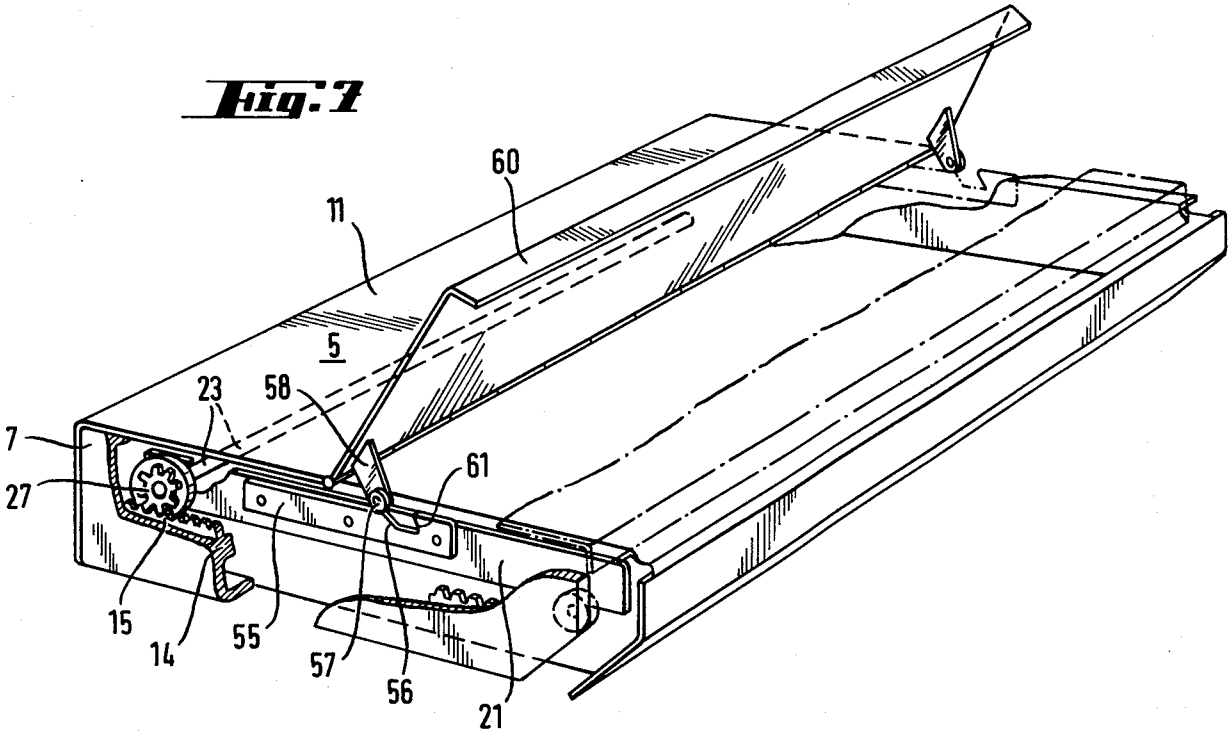
FIG. 7 is a perspective view, partly broken away, of a drawer with a cover flap that can be flipped open.

FIG. 7 shows a third embodiment of the invention for solving the stated problem, in which part of the cover of the sliding unit is flipped up when the drawer is run out.

The parallel guidance of the carriage by means of the guide shaft 23, pinions 27 and rack 15 is identical to the drawer shown in FIG. 1. The lateral struts 21 each carry a guide strip 55, the upper edge of which is constructed as a curved track 56 on which a roller 57 of a sensing finger 58 of a cover flap 60 runs. In the closed position of the cover flap, which is hinged to the rear part of the cover 11, the roller 57 of the sensing finger 58 runs into a curved cutout of the curved track 56 under a hook-shaped undercut 61 which prevents the cover flap 60 from being flipped up by hand. When the drawer is opened, the guide strips 55 are shifted to the right with the lateral struts 21 on both sides of the drawer tray 1 as shown in FIG. 7, while the rollers 57 of the sensing fingers run up on the rising curved tracks 56 and simultaneously flip up the cover flap 60. Only a relatively small shift of the drawer tray 1 in the opening direction is necessary to bring the cover flap 60 into the open position. Since in this construction of the cash drawer, the drawer tray 1 is also moveably disposed in the carriage, the drawer tray can be pulled out further by hand through an additional distance if required.

I claim:

1. Cash drawer for cash registers in tellers' stations, sales counters or the like, comprising a slide-in unit and a drawer tray being movable into and out of said slide-in unit in given directions; said slide-in unit having vertical side plates at opposite sides thereof, a rib being integral with each of said side plates extended along said given directions and projecting toward each other, a rack integral with the top of each of said ribs, and a roller disposed in vicinity of the front of each of said side plates; a guide shaft being rotatably supported at the back of said drawer tray, a pinion being fastened to each end of said guide shaft and being in engagement with one of said racks of said side plates; and said drawer tray having sides and a longitudinal flange integral with each of said sides of said drawer tray being extended along said given directions and supported on said rollers when the drawer is opened and closed.

2. Cash drawer according to claim 1, including a fixed running flange with a running surface being integral with the inner surface of each of said side plates and extended along said given directions, and a guide roller being rotatably supported at each end of said guide shaft for rolling on said fixed flange.

3. Cash drawer according to claim 2, including a guide flange being integral with the upper edge of each of said side plates and angled-off horizontally toward the inside, said guide flange being spaced from said running surface by a distance which is greater than the diameter of said guide rollers.

4. Cash drawer according to claim 1, including a carriage supporting said guide shaft at the back of said drawer tray, said carriage including two vertical side struts, a cross strut connecting the backs of said side struts to each other, bearing pins disposed on said side struts, and support rollers disposed on said bearing pins at the inner surfaces of said side struts for supporting said drawer tray in said carriage along said given directions.

5. Cash drawer according to claim 4, including a cover, a lock disposed on said drawer tray, and a stop being disposed on said cover and being engageable by said lock for limiting the travel direction of said drawer tray in said carriage.

6. Cash drawer according to claim 1, including a spring connected to said guide shaft being biased when the drawer is closed and said pinions roll off on said racks of said ribs of said side plates.

7. Cash drawer according to claim 1, including means for locking said drawer tray when the drawer is closed by locking said guide shaft.

8. Cash drawer according to claim 1, including a cover and gear means coupled to said drawer tray for opening said cover when said drawer tray is run out and for closing said cover when said drawer tray is returned to a closed position.

9. Cash drawer according to claim 8, wherein said cover is a slide being guideable on both sides of said slide-in unit above said drawer tray and having a lower surface, and said gear means comprise racks integral with said lower surface, racks being integral with both of said sides of said drawer tray extended in the longitudinal direction parallel to the upper edges of said sides, bearing pins disposed on said side plates of said slide-in unit, and pinions being supported on said bearing pins and being in engagement with said racks integral with said lower surface of said cover slide and with said racks integral with said sides of said drawer tray.

10. Cash drawer according to claim 8, wherein said cover includes a flap disposed in the forward region thereof for uncovering said drawer tray, and said gear means comprise sensing fingers connected to said cover flap and guide strips having curved tracks formed thereon and being disposed on each of said sides of said drawer tray, said sensing fingers cooperating with said curved tracks for flipping up said cover flap when said drawer tray is run out.

11. Cash drawer according to claim 10, wherein said guide strips have undercuts of said curved tracks formed therein, and said sensing fingers have rollers disposed thereon being slideable on said curved tracks and receivable in said undercuts for locking said cover flap in the closed position of the drawer.

* * * * *